US006539682B1

(12) United States Patent
Ryder

(10) Patent No.: US 6,539,682 B1
(45) Date of Patent: Apr. 1, 2003

(54) BUILDING ELEMENTS AND METHODS IN RELATION TO SAME

(75) Inventor: George Ralph Ryder, Mudgeeraba (AU)

(73) Assignee: Interlock Holdings Pty Ltd., Nerang (AU)

( * ) Notice: Subject to any disclaimer, the term of this patent is extended or adjusted under 35 U.S.C. 154(b) by 0 days.

(21) Appl. No.: 09/674,485

(22) PCT Filed: May 11, 1999

(86) PCT No.: PCT/AU99/00348

§ 371 (c)(1),
(2), (4) Date: Nov. 9, 2000

(87) PCT Pub. No.: WO99/58783

PCT Pub. Date: Nov. 18, 1999

(30) Foreign Application Priority Data

| | | |
|---|---|---|
| May 11, 1998 | (AU) | PP3427 |
| Aug. 7, 1998 | (AU) | PP5101 |
| Feb. 2, 1999 | (AU) | PP8426 |

(51) Int. Cl.[7] ..... E04B 2/00

(52) U.S. Cl. ..... 52/437; 52/505; 52/585.1; 52/742.14

(58) Field of Search ..... 52/437, 503, 505, 52/564, 569, 568, 585.1, 586.1, 590.1, 590.2, 742.14, 742.12; 249/136; 425/424

(56) References Cited

U.S. PATENT DOCUMENTS

| | | | | | |
|---|---|---|---|---|---|
| 2,263,914 | A | * | 11/1941 | Bohn | 52/591 |
| 2,392,551 | A | * | 1/1946 | Roe | 52/591 |
| 3,694,128 | A | * | 9/1972 | Foxen | 425/412 |
| 3,968,615 | A | | 7/1976 | Ivany | |
| 4,075,808 | A | | 2/1978 | Pearlman | |
| 4,115,980 | A | * | 9/1978 | Martel et al. | 52/591 |
| 4,319,440 | A | * | 3/1982 | Rassias et al. | 52/438 |
| 4,441,298 | A | | 4/1984 | Limousin | |
| 5,484,236 | A | * | 1/1996 | Gravier | 405/286 |
| 5,611,183 | A | | 3/1997 | Kim | |
| 5,715,635 | A | | 2/1998 | Sherwood | |

FOREIGN PATENT DOCUMENTS

| | | | | |
|---|---|---|---|---|
| AU | 20487/92 | | 1/1993 | |
| CA | 1197391 | | 12/1985 | |
| DE | 2452373 | A1 | 5/1976 | |
| GB | 1534501 | | 12/1978 | |
| GB | 2065740 | A * | 7/1981 | 52/591 |
| WO | WO 94/11587 | | 5/1994 | |
| WO | WO 96/11307 | | 4/1996 | |

* cited by examiner

*Primary Examiner*—Carl D. Friedman
*Assistant Examiner*—Naoko Slack
(74) *Attorney, Agent, or Firm*—Hoffman, Wasson & Gitler

(57) ABSTRACT

A dry wall building system comprises courses of building blocks where the building blocks are joined end to end by keys. Each of the blocks comprising sidewalls, endwalls and at least one vertical cavity or slot, at least one first channel in the upper surfaces of the endwalls and at least one second channel in the lower surfaces of the endwalls, the arrangement and construction being such that when blocks are laid one upon another the channels and the said at least one cavity or slot of the blocks can be aligned to provide an internal network of horizontal and vertical infill passages which can be filled with a settable material to seal joints between the blocks and to provide load bearing support between respective courses of blocks. A method of manufacturing blocks is also disclosed.

15 Claims, 11 Drawing Sheets

BUILDING ELEMENTS AND METHODS IN RELATION TO SAME

TECHNICAL FIELD

This invention relates to a method for constructing walls and footings from building elements such as construction blocks and has particular relevance to masonry blocks and buildings having walls constructed therewith.

BACKGROUND ART

There have been proposed many different forms of masonry blocks for use in building constructions and these are generally manufactured with a peripheral wall with apertures passing therethrough. The blocks, when built into a wall, are generally staggered, that is with the blocks in alternative rows being displaced half a block with from those in the adjacent row and are normally provided with mortar joints.

Such blocks have the advantage of lightness in weight and are less costly than bricks. Additionally, in staggered block constructions a level foundation is required for supporting the blocks to ensure correct alignment between the blocks. Furthermore, the blocks are required to be manufactured to stringent tolerances otherwise staggering of the blocks becomes difficult.

Building blocks are generally manufactured by machinery which tamps a moist mixture of concrete to dies whilst the dies and/or a table beneath the dies are vibrated. As can be readily understood such techniques result in wear and tear to the dies and product which was made from a new die would not necessarily be dimensionally the same as product manufactured subsequently. Difficulties arise when the blocks are laid in multiple courses because of this problem.

Australian patent No. AU-A-24868/95 describes a method for manufacturing walls from masonry blocks having end apertures opening to the exterior of the block, the methodology including the steps of arranging blocks in a substantially end-to-end butting relationship so that the apertures are adjacent and oppose each other, interconnecting blocks by a plug or dowel adapted to extend through the openings and having portions receivable in the respective apertures so as to hold the blocks in a required position relative to each other and setting further blocks in alignment one above the other.

Whilst the above methodology has proved to be satisfactory we perceive that there are a number of improvements which could be effected to a number of aspects of such systems and it is an object of the present invention to provide same.

Block systems known as "dry-wall" have to date had limited applications because of inherent strength limitations. The systems are generally used only for single storey structures.

An object of the present invention is to provide a dry wall building system with improved structural and loading capabilities.

Further objects and advantages of the present invention will become apparent from the ensuing description which is given by way of example.

DISCLOSURE OF THE INVENTION

According to a first aspect of the present invention there is provided a building block comprising sidewalls endwalls and at least one vertical cavity or slot, at least one first channel in the upper surfaces of the endwalls and at least one second inverted channel in the lower surfaces of the endwalls, the arrangement and construction being such that when blocks are laid one upon another the channels and the said at least one cavity or slot of the blocks can be aligned to provide an internal network of horizontal and vertical grouting passages which can be filled with settable material to seal joints between the blocks and to provide load bearing support between respective layers of blocks.

The said at least one first channel can be substantially U-Shaped.

The said at least one second inverted channel can be divided by a central ridge.

Horizontal ledges can be provided at the upper outer edges of the sidewalls with respect to which flanges of sidewalls of an overlaid blocks can be secured.

The block can have having at least one vertical pert groove in the end walls thereof.

The block can have two spaced vertical pert grooves in the end walls thereof.

The block can have keyslots in endwalls thereof.

According to a further aspect of the present invention there is provided a wall structure comprising multiple courses of building blocks aforesaid in an end to end abutting relationship including keys fixed in the keyslots of the blocks.

The wall structure can include including vertical and/or horizontal steel reinforcing members positioned in aligned cavities and channels in the blocks.

Horizontally disposed passages and vertically disposed cavities within the structure can be grouted.

The keys can each comprise an elongate medial flange and webs positioned on opposite edges of the flange each of said webs including a plurality of ribs which extend from the sides of the flange and which, commencing from the outermost ribs are of diminishing depth.

Surfaces of the flanges of the keys can be irregular.

The irregularity of the flange surfaces of each key can be provided at least in part, by a network of extending knobs.

The irregularity of the surfaces of the flange of each key can be provided at least in part, by a network of recesses.

According to a still further aspect of the present invention there is provided a method of constructing a footing or wall comprising (a) laying a first course of blocks as aforesaid, (b) inserting keys in adjacent slotted ends of the building elements so that a portion of the keys extends upwardly from the slotted ends, and (c) laying a further course of the building elements on the first course so that the slotted ends of the building elements engage over the extending portion of the keys, and inserting a further set of keys in the slots of said further course of building elements.

The keys can be approximately the same depth as the building elements and when placed in the slots, approximately half of the total depth of the keys extend from the slots.

Horizontal and/or vertical reinforcing members can be laid in selected courses of the blocks.

The vertically disposed cavities or slots and horizontally disposed passages in multiple layers of blocks can be grouted.

According to a still further aspect of the present intention there is provided a method of forming a building element from a cementitious or other mouldable substance comprising the steps forming the element within a mould box, separating a base of the mould box prior to release of the element from the mould box and re-supporting the formed element on its release from the mould box.

The base of the mould can be separated whilst a tamping plate is engaged with the mould box.

The upper surface of the base of the mould can be provided with a plurality of projections which shame the base of the building element.

The projections can form longitudinal and/or lateral channels in the bottom wall of the formed element.

The base of the mould can be used to form functional and/or decorative surfaces or shapes on building elements such as blocks, panels, pavers and the like.

BRIEF DESCRIPTION OF THE DRAWINGS

Aspects or the present invention will now be described with reference to the accompanying drawings in which.

Figure 2:
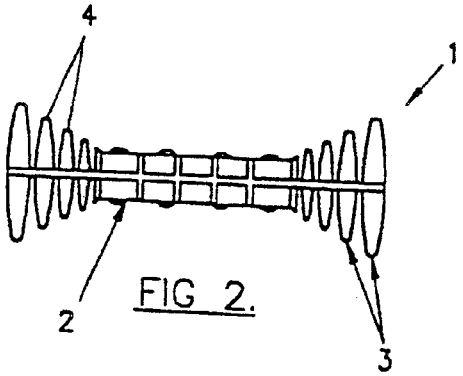
FIGS. 2, 3, 4 and 5 are end, cross-sectional side and plan views respectively of the key of FIG. 1.
Figure 3:
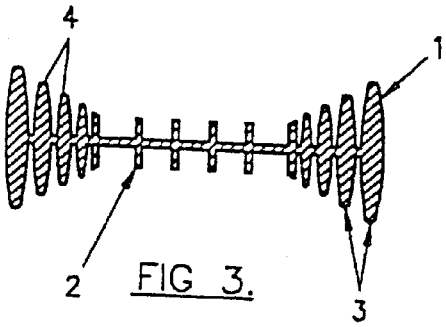
Figure 1:
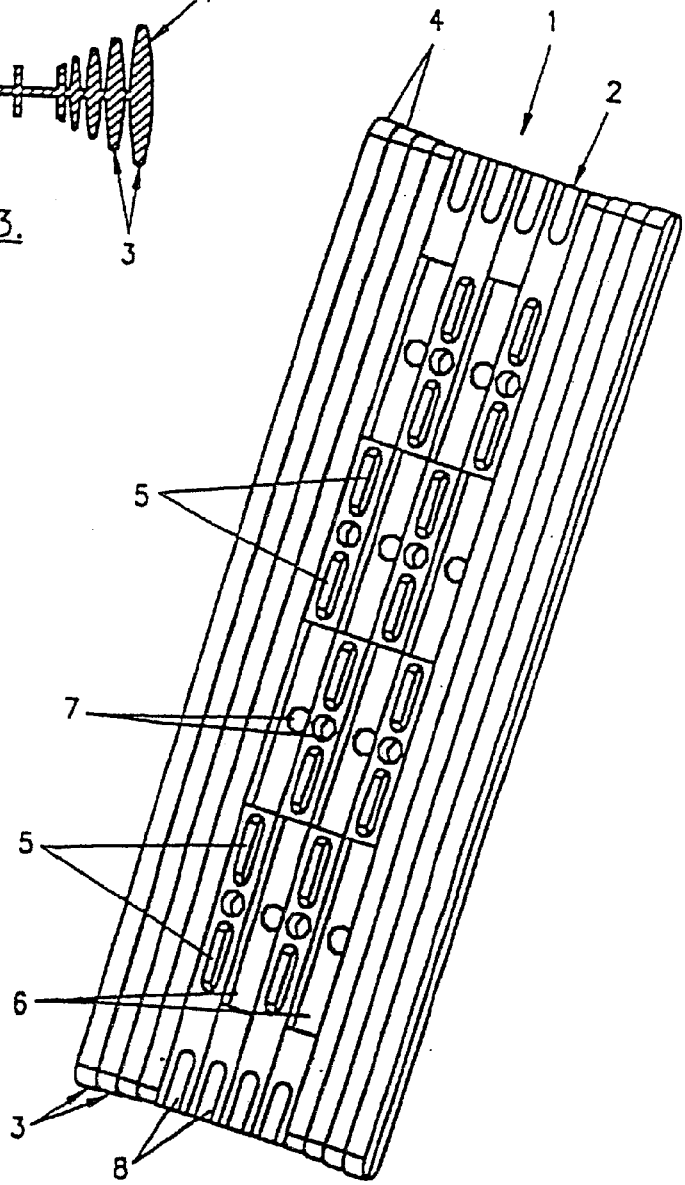
FIG. 1 is a top perspective view of a key for joining the ends of building blocks in accordance with one aspect of the present invention.
Figure 4:
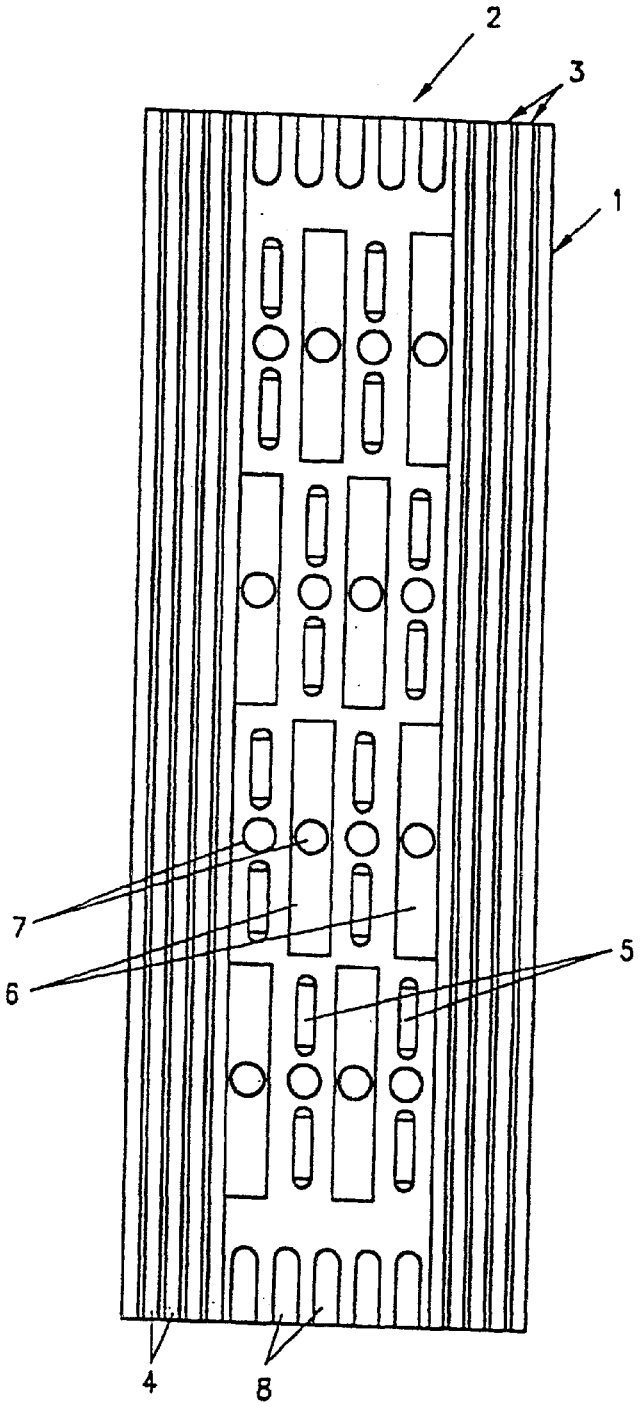
Figure 5:
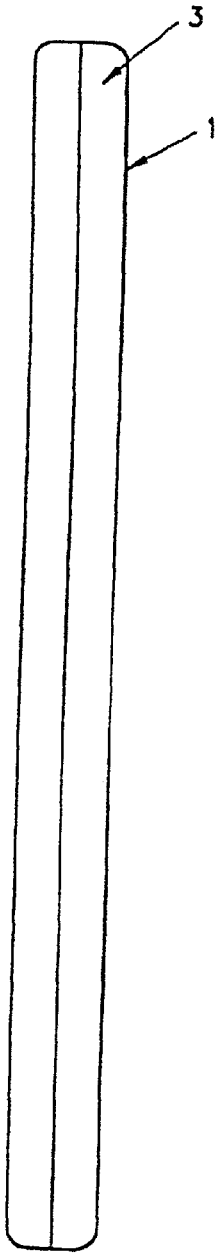

With respect to FIGS. 1 to 6 of the drawings, a key in accordance with the present invention is indicated by arrow 1. The key 1 comprises an elongate medial flange generally indicated by arrow 2 and webs generally indicated by arrow 3. Each of the webs 3 consists of a plurality of ribs 4 which extend from both sides of the flange 1 and which, commencing from the outermost web, are of diminishing depth.

The surfaces of the flange are irregular such irregularity being provided by a network of knobs 5, recesses 6, apertures 7, and flutes 8. Whilst some of these aspects assist to minimize material costs, and assist the moulding process from which the keys are made, the elongated knobs 5 have a functional purpose.

Figure 6:
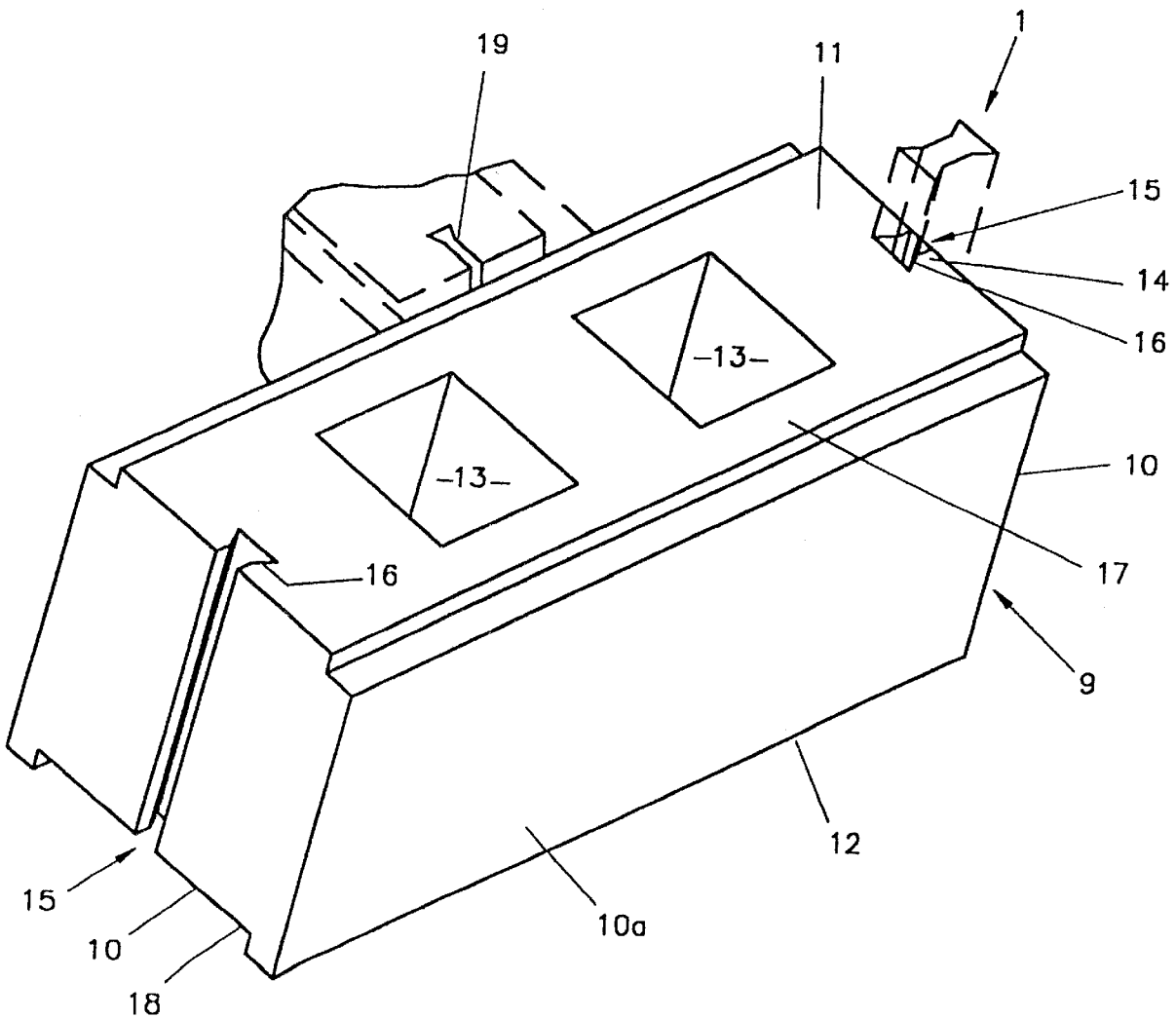
FIG. 6 is a perspective view of a key and complementary building elements for a system according to the present invention.

A building element generally indicated by arrow 9 of FIG. 6 is provided with end walls 10, side walls 10*a,* a top wall 11 and a bottom wall 12. The building element is similar dimensionally to a standard building block, is rectilinear in shape and can include cavities 13.

The distance between the peaks of the knobs 5 which extend from both sides of flange 2 of the key 1, is similar to or slightly greater than the width of a first portion 14 of a slot indicated by arrow 15 in the ends and/or sides of the blocks. Staggering of the knobs 5 ensures that if the first portion 14 of the slot 15 is irregular because of the die wear or other manufacturing causes adequate contact is made with the walls of the first portion 14 of the slot 15. Similarly, if divergent walls 16 of a second portion of the slot 15 are irregular, the spaced ribs 4 of each web 3 will ensure adequate contact with walls 12.

The top and bottom walls 11, 12 of the blocks 9 can be provided with a tongue 17 and groove 18 respectively so that the blocks key into one another and are readily laid on a level plane. The key 1 assures alignment of the blocks in the vertical plane and the tongue and groove arrangement assures alignment on a horizontal plane.

In the event that branch walls are provided in a structure slots 19 for the plugs 1 can be provided in the side walls of the blocks 9.

The length of each key 1 is approximately the same as 35 the depth of each block 9 and, as mentioned earlier, the keys are set in the slots of abutting blocks so that approximately half the length of each key extends above each course of blocks as they are laid.

Figure 7:
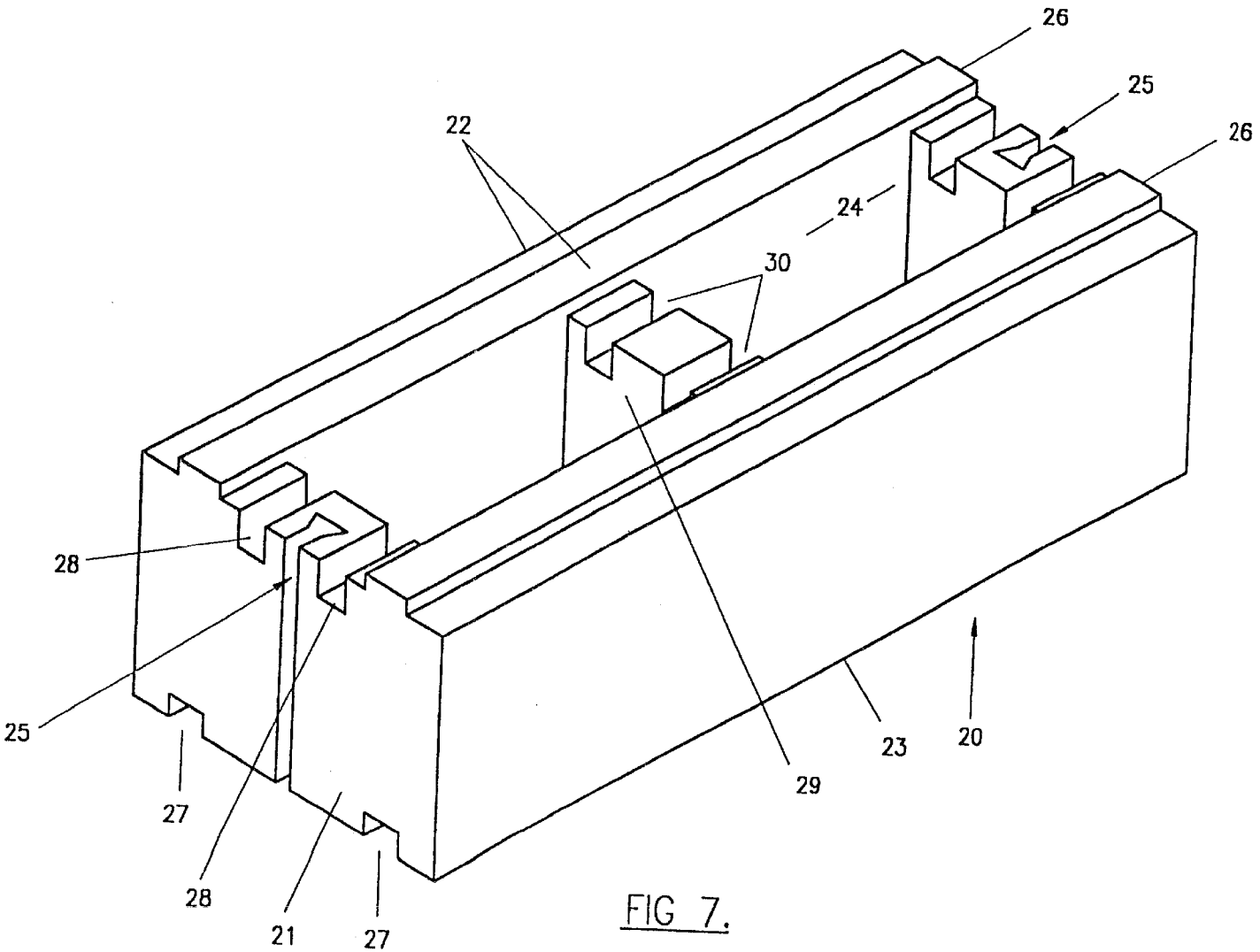
FIG. 7 is a perspective view of a building block in accordance with a further aspect of the present invention.
Figures 8, 8A:
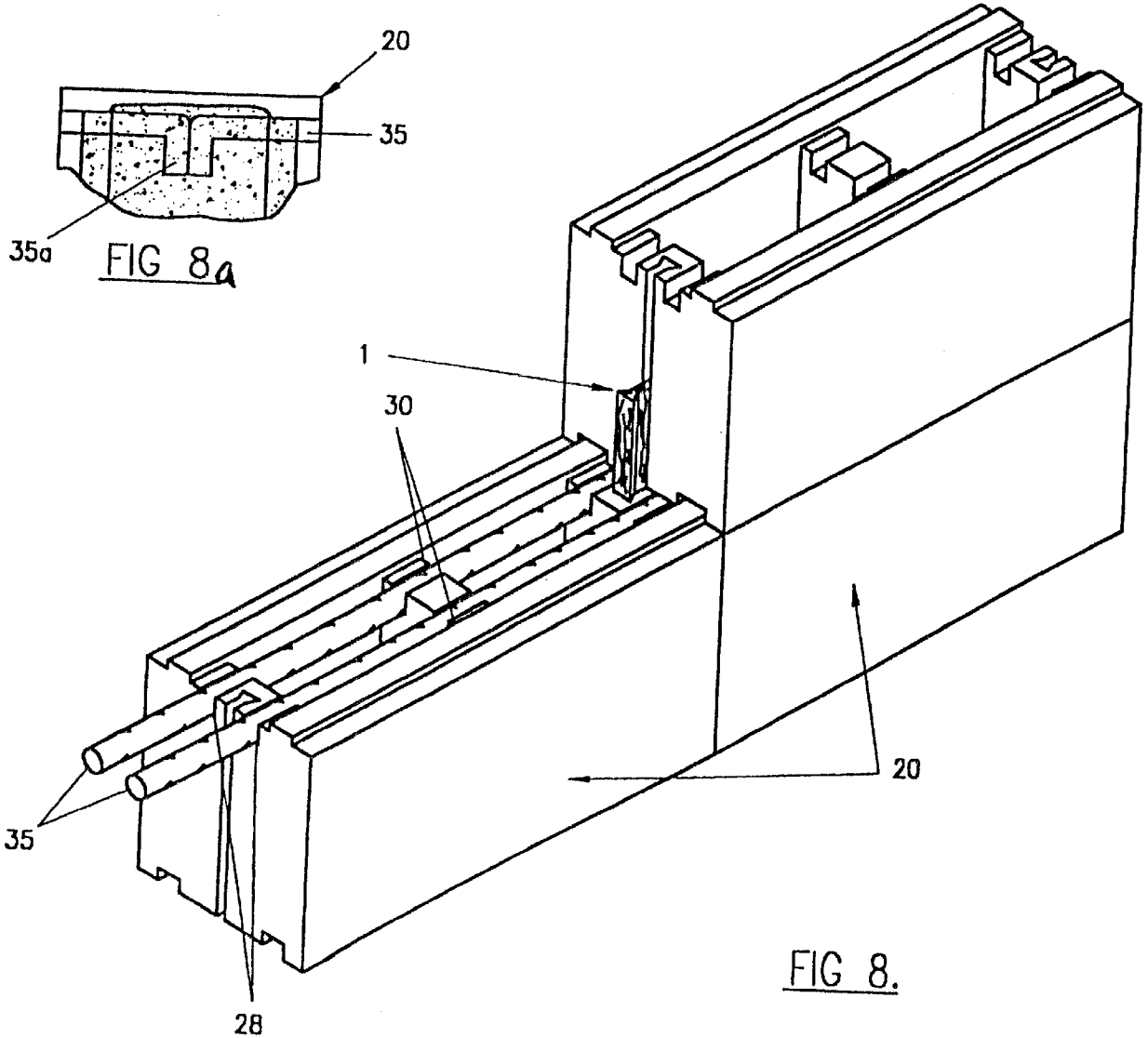
FIGS. 8 and 8*a* are perspective and sectional drawings respectively of a wall structure utilising the blocks of FIG. 7, and FIGS. 9, 10 and 11 are side, end and plan views respectively of a building block in accordance with a further aspect of the present invention.

With respect to FIGS. 7 to 8*a* of the drawings and in accordance with a further aspect of the present invention, there is provided a building element having some similarities with the element of FIG. 6 but with further features. The building element illustrated by FIGS. 7 to 8*a* generally indicated by arrow 20 is provided with end walls 21, a top wall 22 and a bottom wall 23. The building element 20 is similar dimensionally to standard building blocks, is rectilinear in shape and may include cavities 24. The element is provided with slots generally indicated by arrow 25 similar to that described in relation to the element illustrated by FIG. 6, and in this instance illustrated by FIGS. 7 to 8*a* of the drawings, the top wall 22 is provided with two longitudinal tongues 26 and the bottom wall two longitudinal grooves 27. Flanking either side of the slot 25 in top wall 22 are further grooves 28 and where the block is provided with a centre partition 29, further grooves 30 in the partition can be provided. The grooves 28, 30 allow horizontal reinforcing members to be laid in selected courses of a structure.

FIGS. 8 and 8*a* of the drawings illustrate a wall structure in accordance with the present invention including building elements 20 laid in courses, each element having end walls joined by keys such as key 1 previously described with courses of the building elements reinforced by a horizontal reinforcing members 35. The reinforcing members 35 are laid in grooves 28, 30 of the keys 1 and can be keyed in using a grout or other mouldable materials. A wall structure as illustrated can also include vertical reinforcing and other standard features such as openings, lintels, bond beams and the like.

FIG. 8*a* illustrates a convenient method of joining the ends of horizontal reinforcing members 35 with a cavity in a building element. Abutting bent ends of reinforcing members can be keyed into the cavity with concrete or grout or other mouldable materials such as hardening resins to ensure continuity between same. The ends may be pre-tied although this is not considered to be essential.

With respect to FIGS. 9 to 13 of the drawings illustrating a further embodiment of a building element according to the present invention, a block generally indicated by arrow 36 can comprise sidewalls and endwalls 37, 38, respectively, at least one vertical cavity or slots 39, a first channel 40 in the upper surfaces of the endwalls 38 and an inverted second channel or channels 41 in the lower surfaces of the endwalls. When a wall structure is erected the cavities or slots and channels can be aligned to provide an internal network of horizontal and vertical infill passages generally indicated by arrows 42, 43 (see FIGS. 12 and 13).

The first channels 40 can be substantially U-shaped and second channels 41 can be similarly shaped and be divided by a ridge 44.

The block 36 can be provided with horizontal ledges 45 at upper outer edges of the sidewalls 37 with respect to which flanges 46 of overlaid blocks can be secured.

The block 36 can be provided with a single vertical cavity 47 between the endwalls 38 and pert slots or grooves 49 in endwalls thereof, and in common with previously described embodiments, keyslots 49 in endwalls 38 thereof can be provided.

When a structure is erected and the passages 42, 43 filled with grout (FIGS. 12 and 13) all joints 50, 51 between the blocks are sealed by same and the grout in the horizontal passages 42 provides load bearing support between respective layers of blocks.

Keys 1 (shown in general outline only in FIG. 13) can be used to join the ends of the blocks.

Figure 9:
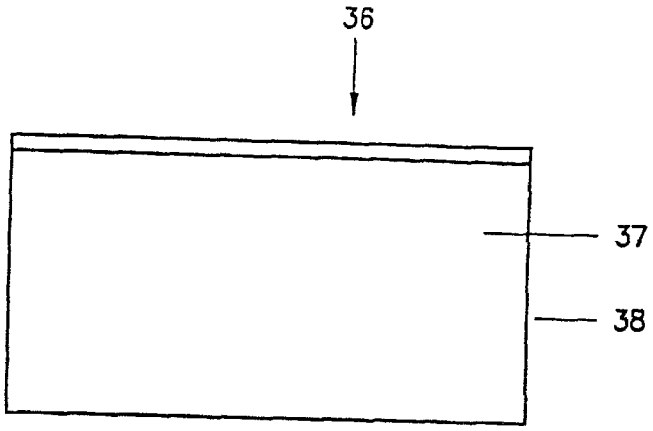
Figure 10:
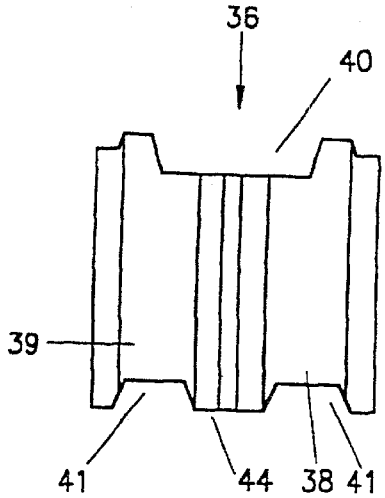
Figure 11:
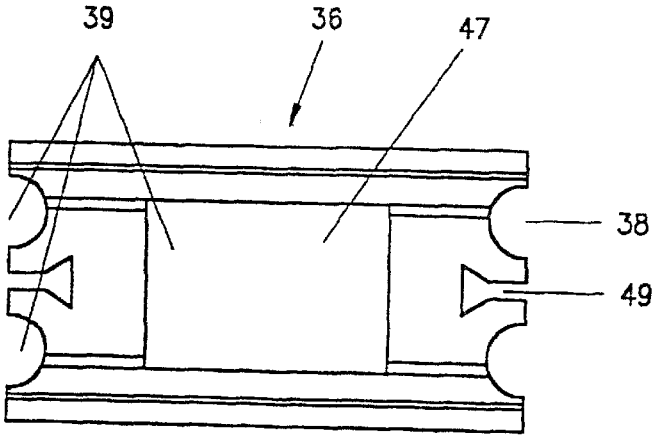
Figure 12:
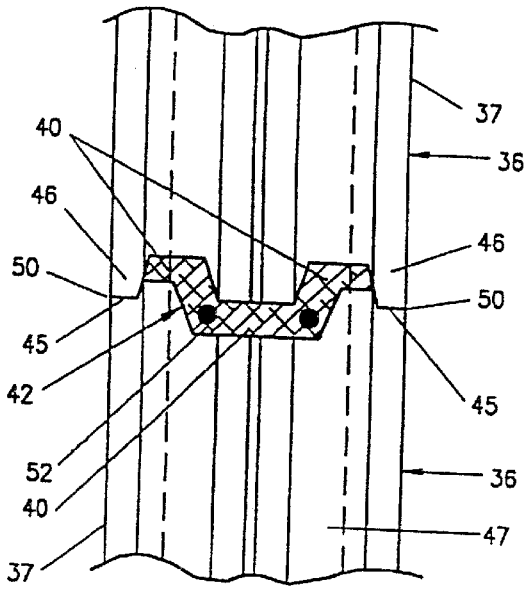
FIGS. 12 and 13 are end and plan views of a grouted wall structure utilising the blocks of FIGS. 10, 11 and 12, and FIGS. 14, 15, 16 and 17 are side and perspective views of building blocks in accordance with further aspects of the present invention.
Figure 13:
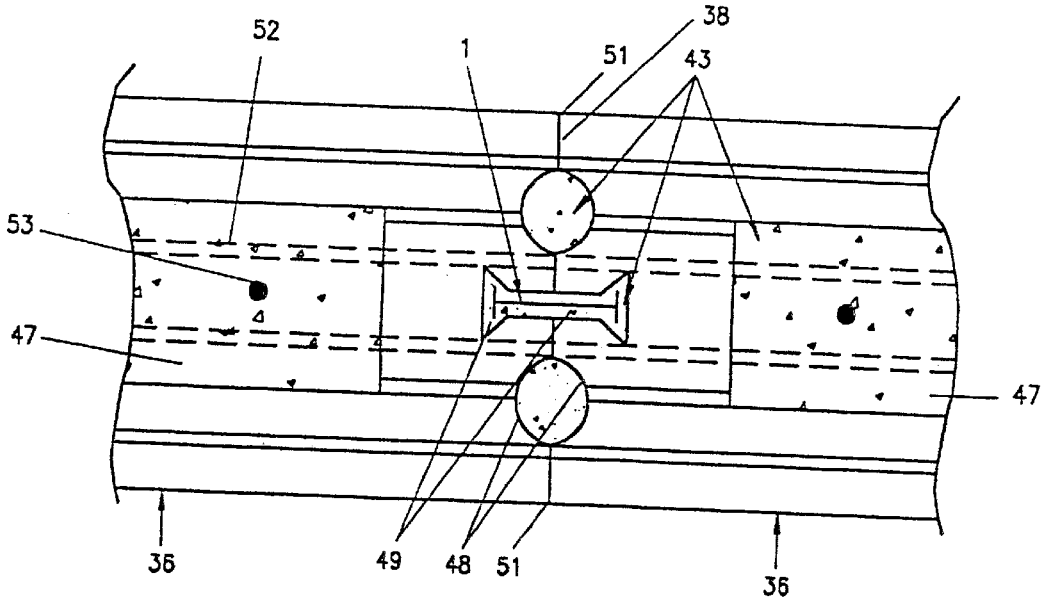

A wall structure utilising building blocks and the methodology described in relation to FIGS. 9 through to 18 is greatly superior to conventional dry wall methods and trials and engineering reports to date have indicated superiority under structural loading, wind loading, earth quake resistance and with respect to regulations relating to fires.

It is well known in the construction industry that the integrity of conventional block walls which are grouted can be severely compromised by bad workmanship and the use of mortar mixes which are not of the required standard. The present invention eliminates these problems and provides an opportunity for so called "dry-wall" methodology to be used on multistory buildings and for completed walls to be used as load bearing and cyclone proof structures.

The block configuration of FIGS. 9 to 13 provides for the placement of both horizontal and vertical reinforcement bars 52, 53 in accordance with design requirements.

Figure 14:
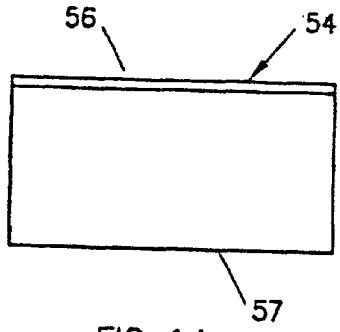
Figure 15:
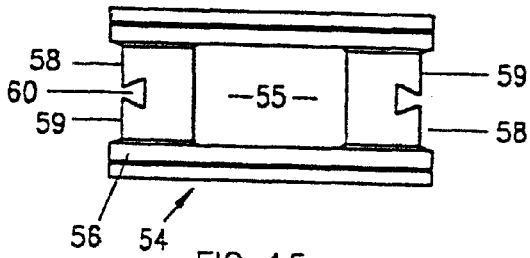

FIGS. 14 and 15 of the drawings illustrate top and side profiles of a further form of block according to the present invention block generally indicated by arrow 54 which has a single central cavity 55. Top and bottom walls 56, 57 are shaped similarly to the block of FIGS. 9 to 13 and in this case a single U-shaped pert groove 58 is provided in the end walls 59 of the block. A key slot 60 is also provided.

Figure 17:
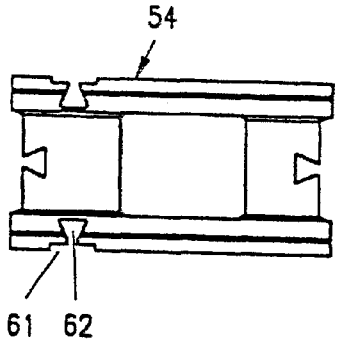
Figure 16:
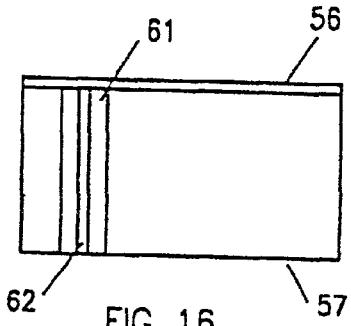

FIGS. 16 and 17 show the block of FIGS. 14 and 15 with an additional branch wall pert groove 61 and key slot 62 for the joining of a branch wall (not shown) similar to that described in relation to FIG. 6.

Figure 18:
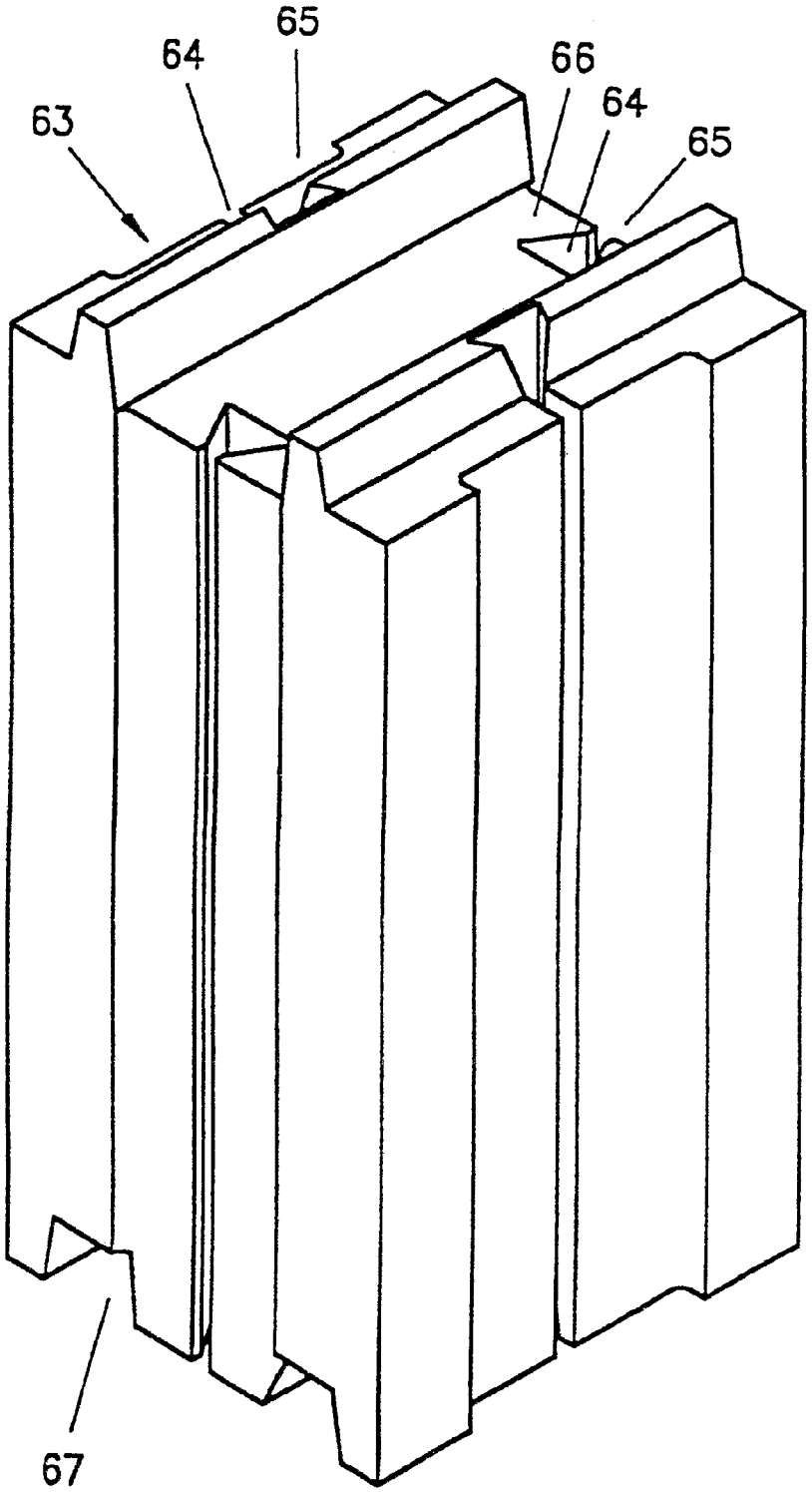
FIG. 18 is a perspective view of a corner or junction block in accordance with further aspects of the present.

FIG. 18 of the drawings illustrates a corner block generally indicated by arrow 63 is provided with key slots and pert grooves 64, 65 similar to that described in relation to FIGS. 14 to 17 and top and bottom walls 66, 67 also of similar shape to the block of FIGS. 14 to 17. The corner block 63 can be provided as a unit of a block set with the blocks of FIGS. 14 to 17 and the materials of laying courses of blocks, grouting and reinforcing as previously described in relation to FIGS. 9 to 13 similarly adopted.

Most block making machinery throughout the world is very similar in terms of basic componentry and mode of operation in that blocks, pavers and the like are formed within a mould box and a concrete mix from which the blocks or pavers is tampered by tampers to compress the concrete mix. The tampers and mould boxes are then removed leaving the formed blocks on pallets. The pallets and fresh product is then moved away from a mould head for curing. Machinery of this type is manufactured and distributed throughout the world under the names of Besser and Columbia.

Conventional block making apparatus has the disadvantage of leaving a timber pallets very worn where direct contact is made. Because of this wear there is a requirement to change pallets regularly. Alternative steel pallets are very expensive and are extremely heavy and the additional weight of steel pallets has not been allowed for in most existing machinery.

The quality of the pallet will always determine the quality of the bottom of the block. If pallet is worn, say 3 mm over say 12 months, then the block height will increase accordingly.

According to a still further aspect of the present invention there is provided a method of forming a building element within a mould box comprising the steps of forming the element within the mould box, removing a base for the mould box prior to release of the element from the mould and re-supporting the element on its release from the mould box.

Figure 19:
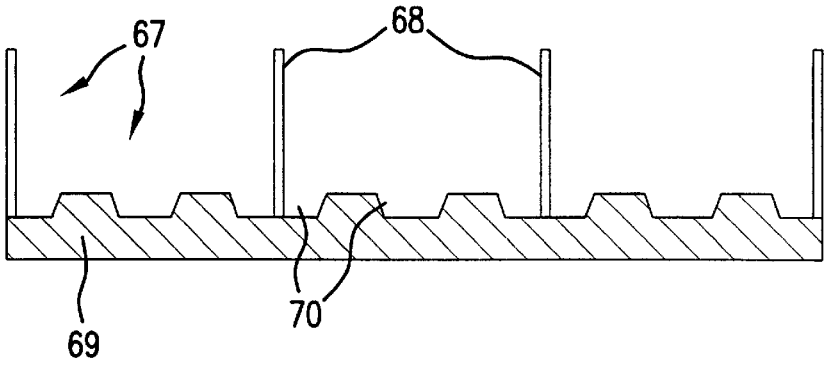
FIGS. 19 to 19*e* are diagrammatic drawings of a mould, mould box and tamping head arrangement in accordance with further aspects of the present invention.
Figure 19A:
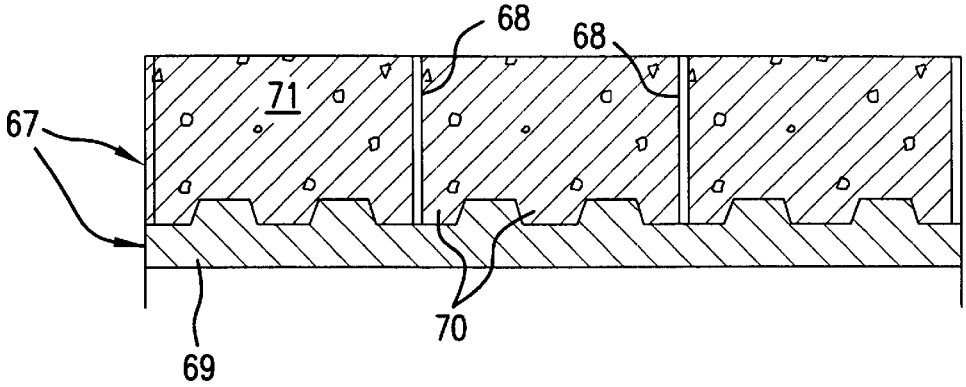
Figure 19B:
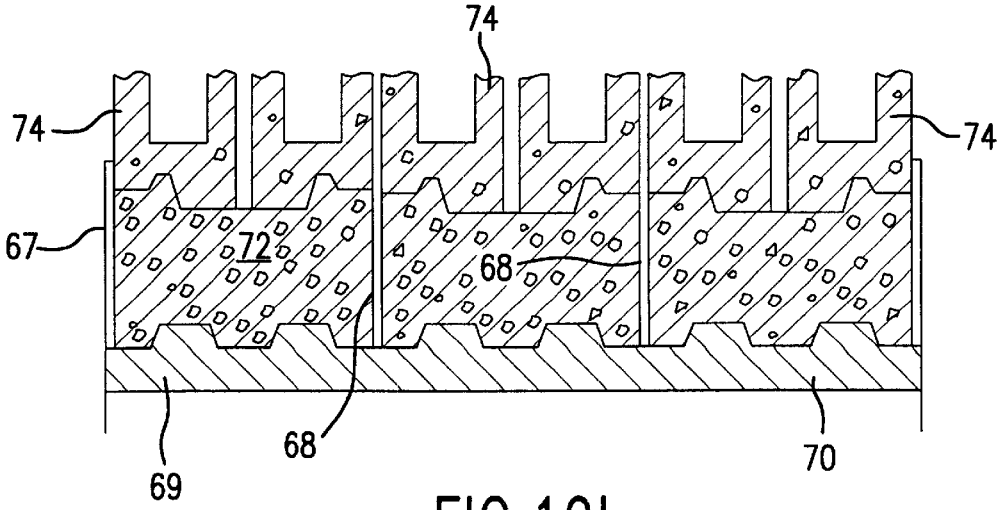
Figure 19C:
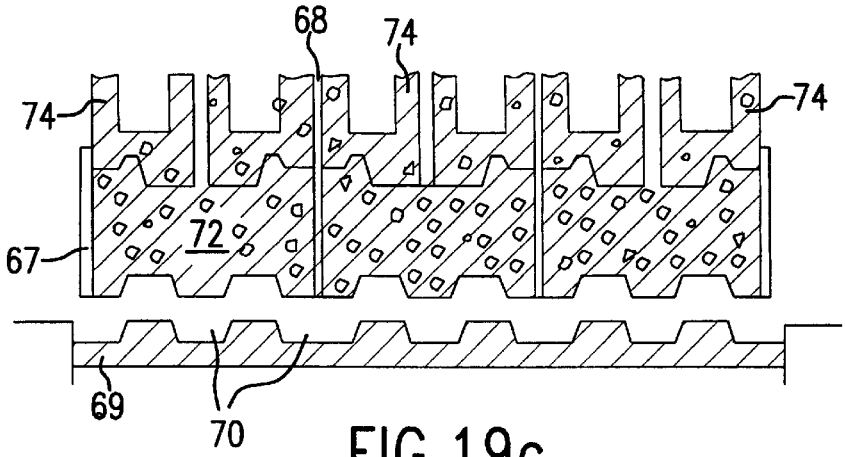
Figure 19D:
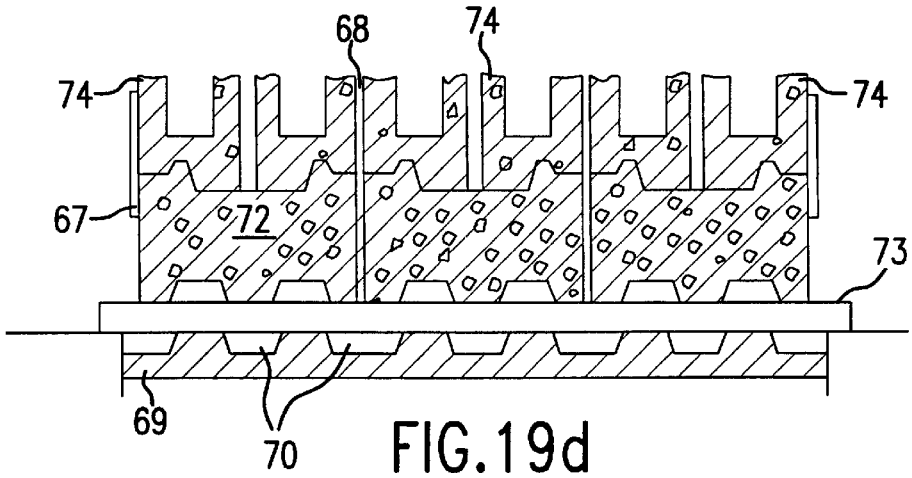
Figure 19E:
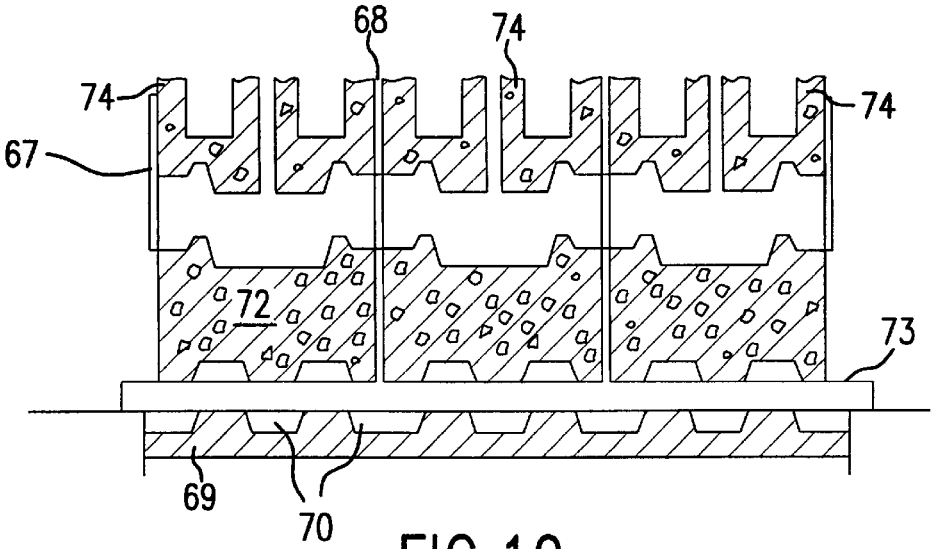

With respect to FIGS. 19 and 19*e* of the drawings and in accordance with further aspects of the present invention a mould box generally indicated by arrow 67 can comprise a single or multiple mould casing 68 and may be provided with a polished high tensile steel base plate 69. Rebates 70 can be provided in the base plate 69 which can be hydraulically locked onto the mould casing 68 when required.

The mould box 67 can be filled with a mouldable mix 71 and be tamped and vibrated in the conventional manner.

The mould casing 68 can be lifted off the base plate 69 leaving a formed element 72 suspended in the mould. A pallet 73 can then be moved under the mould box 67. The mould box can then be lowered to deposit the element 72 on the pallet 73. The pallet 73 then moves to a curing/drying station or situation. The process is then repeated.

The formed elements 72 stay in the mould casing 68 when it is suspended after the base plate 69 is removed. This allows pallet 73 to replace the base plate 69 of the mould and the formed element is then released. Suction between the top and side walls of the formed element 72 and the sides and a tamping plate 74 of the mould and moisture combine to hold the formed elements in place whilst pallets are being placed.

Elements such as building blocks have substantial depth and a large surface area in contact with the sides of the mould box. Where an element being formed is of lesser depth, e.g. a paver or brick "suction" may be increased by creating a partial pressure headspace in the region above the top wall of the element and the tamping plate 74.

A sequence of operation of the specific apparatus of FIGS. 19 to 19*e* can be as follows:

FIG. 19

The mould casing 68 and base plate 69 are united.

FIG. 19*a*

An aggregate mix 71 falls into the mould box 67 onto the base plate 69.

FIG. 19*b*

A tamping plate 74 stamps out the profile of the top wall of a block and the whole unit is vibrated.

FIG. 19*c*

The mould casing 68, tampers 74 moves up with the mix 71 intact and separates from the base plate 69.

FIG. 19*d*

A conveyed pallet 73 is inserted on top of the base plate 69 and the mould casing and tampers are withdrawn.

FIG. 19*e*

The tamper 74 raise and leave formed blocks on pallets which can then be removed for curing of the formed blocks to take place. The whole process is repeated again.

Apparatus and methodology such as described in relation to FIGS. 19 to 19*e* has significant advantages, notably:

1. This procedure will allow, not only longitudinal grooves or recesses to be formed in the base of building elements but grooves and recesses at right angles to the longitudinal grooves.

2. A more exact height block, brick or paver will be consistently achieved.

3. Because pallets are only required for the support and removal of formed products wear and tear is minimal. Cheaper timber pallets can be used resulting in substantial savings in manufacturing and plant costs.

Aspects of the present invention have been described by way of example only and it should be appreciated that modifications and additions may be made thereto without departing from the scope thereof as defined in the appended claims.

The claims defining the invention are as follows:

1. A building block comprising sidewalls, endwalls having vertical keyslots therein each having an entry portion and a widened subsequent portion, at least one vertical cavity or slot, at least one first channel in the upper surfaces of the endwalls extending substantially throughout the width of the block and at least one second inverted channel in the lower surfaces of the endwalls extending substantially throughout the width of the block and intruding into the sidewalls of the blocks, the arrangement and construction being such that when blocks are laid one upon another in courses and the endwalls of blocks are joined by placement of keys in the keyslots the channels and the said at least one cavity or slot of the blocks will be aligned to provide an internal network of horizontal and vertical infill passages which can be filled with a settable material to seal joints between the blocks and to provide load bearing support between respective side and endwall courses of the blocks.

2. A building block as claimed in claim 1 wherein the said at least one first channel is substantially U-shaped.

3. A building block as claimed in claim 1 wherein the said at least one second inverted channel is divided by a central ridge.

4. A building block as claimed in claim 1 having horizontal ledges at the upper outer edges and raised portions at an upper inner edge of the sidewalls with respect to which flanges of sidewalls of an overlaid block can be secured.

5. A building block as claimed in claim 4 having grooves in the end walls thereof which are partially recessed into the sidewalls.

6. A wall structure comprising multiple courses of building blocks as claimed in claim 1 and including vertical and/or horizontal steel reinforcing members positioned in aligned cavities and channels in the blocks.

7. A wall structure as claimed in claim 6 wherein the keys each comprise an elongate medial web and flanges positioned on opposite edges of the wedge each of said flanges including a plurality of ribs which extend from the sides of the web and which, commencing from the outermost ribs are of diminishing depth.

8. A wall structure as claimed in claim 1 wherein horizontally disposed passages and vertically disposed cavities within the structure are grouted.

9. A wall structure as claimed in claim 1 wherein surfaces of webs of the keys are irregular.

10. A wall structure as claimed in claim 9 wherein the irregularity of the web surfaces of each key is provided at least in part, by a network of extending knobs.

11. A wall structure as claimed in claim 9 wherein the irregularity of the surfaces of the flange of each key is provided, at least in part, by a network of recesses.

12. A method of constructing a footing or wall comprising the steps of:

(a) laying a first course of blocks as claimed in claim 1, (b) inserting keys in adjacent slotted ends of the building elements to align the blocks, and (c) laying a further course of the building elements on the first course and inserting keys to the slotted ends of adjacent building elements so that the keys partially extend into the first course and partially into the second course.

13. The method of claim 12 wherein the keys are approximately the same depth as the building elements.

14. A method as claimed in claim 12 including laying horizontal and/or vertical reinforcing members in selected courses of the blocks.

15. The method of claim 12 wherein vertically disposed cavities or slots and horizontally disposed passages in multiple layers of blocks are grouted.

* * * * *